United States Patent [19]

Hermanns

[11] Patent Number: 5,035,370

[45] Date of Patent: Jul. 30, 1991

[54] METHOD AND APPARATUS FOR AVOIDING RIBBON WINDINGS WHEN WINDING A CROSS-WOUND BOBBIN

[75] Inventor: Ferdinand-Josef Hermanns, Erkelenz, Fed. Rep. of Germany

[73] Assignee: W. Schlafhorst AG & Co., Mönchengladbach, Fed. Rep. of Germany

[21] Appl. No.: 528,140

[22] Filed: May 23, 1990

[30] Foreign Application Priority Data

May 24, 1989 [DE] Fed. Rep. of Germany ..... 3916918

[51] Int. Cl.[5] ..... B65H 54/38

[52] U.S. Cl. ..... 242/18.1

[58] Field of Search ..... 242/18.1, 18 DD, 18 R, 242/36

[56] References Cited

U.S. PATENT DOCUMENTS 4,696,435 9/1987 Hermanns ..... 242/18.1

4,805,844 2/1989 Hermanns et al. ..... 242/18.1 X

FOREIGN PATENT DOCUMENTS 6604456 1/1970 Fed. Rep. of Germany .

3521152 12/1986 Fed. Rep. of Germany .

3703869 8/1988 Fed. Rep. of Germany .

*Primary Examiner*—Stanley N. Gilreath

*Attorney, Agent, or Firm*—Herbert L. Lerner; Laurence A. Greenberg

[57] ABSTRACT

The method and apparatus avoids ribbon windings when winding a cross-wound bobbin or cheese being driven by a drive drum having reversing thread grooves for yarn guidance and a drive mechanism having a course of motion. The circumferential speed of the drive drum is continuously varied. The cheese is accelerating and decelerating exclusively with the drive drum. The drive drum is accelerated and braked with the drive mechanism of the drive drum in accordance with a predeterminable periodic function. The cheese is rotated with a course of motion following the course of motion of the drive drum in a permanently phase-displaced manner.

19 Claims, 3 Drawing Sheets

FIG. 1
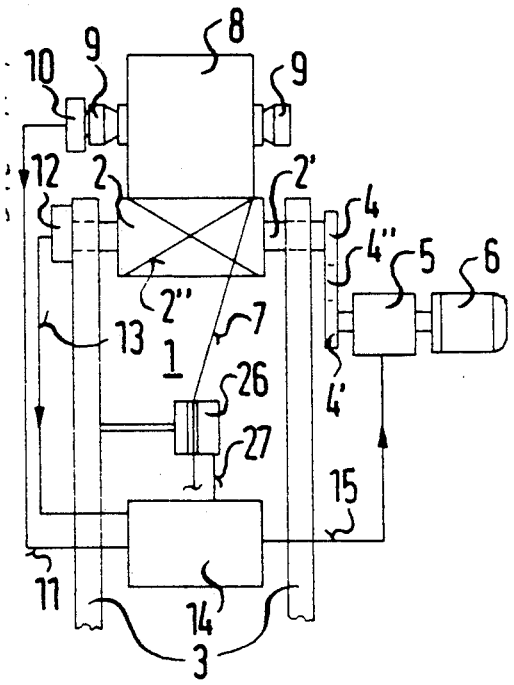
FIG. 2
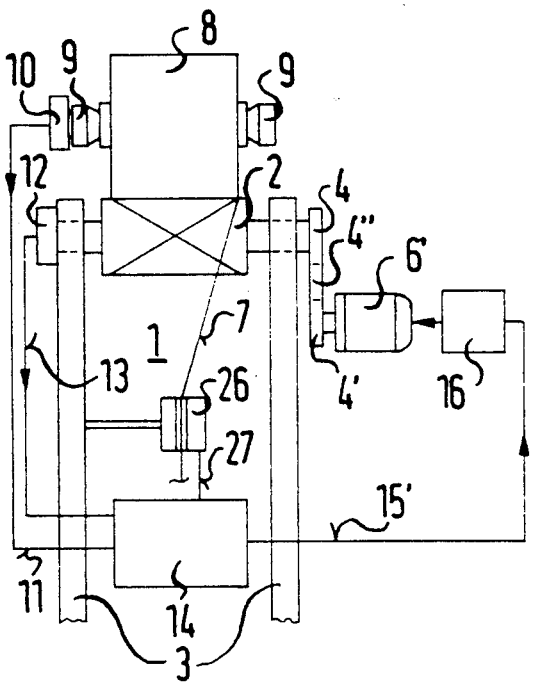
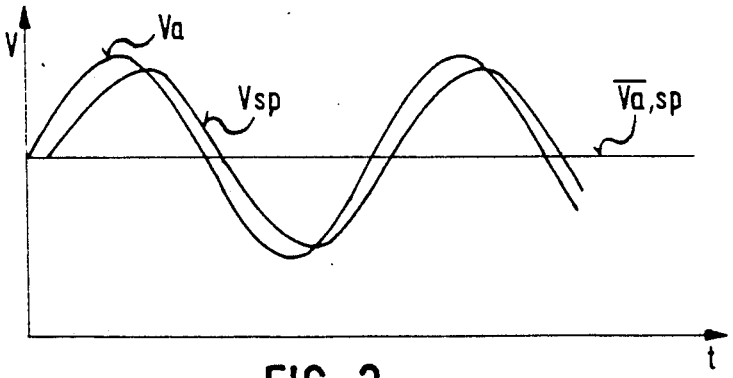
FIG. 3

METHOD AND APPARATUS FOR AVOIDING RIBBON WINDINGS WHEN WINDING A CROSS-WOUND BOBBIN

The invention relates to a method and apparatus for avoiding ribbon windings when winding a cross-wound bobbin or cheese being driven by a drive drum having reversing thread grooves for yarn guidance, wherein the circumferential speed of the drive drum varies continuously.

Such methods and apparatus are intended to prevent the creation of so-called ribbon windings, that is windings which are located close together or on top of one another, that occur on the bobbin circumference from time to time during winding within certain diameter ranges.

A method is known in which a drive drum that drives the cheese by frictional force is brought into temporally limited drive connection with a drive shaft through a friction roller being periodically pivoted into position. After an interruption in the drive, when the friction roller pivots inward again, slippage occurs between the drive drum and the cheese which is intended to break up and disentangle the ribbon winding that is forming The ribbon winding is only inadequately disentangled, particularly because the slippage only occurs periodically.

It is also known to brake an element connected to the cheese with varying braking force during the winding of the cheese. The braking force can be set and varied in such a way that a slippage of varying magnitude occurs between the cheese and the drive drum. The rotating element is brought into contact with a brake that has an operative connection with a brake force adjuster. The brake is relatively heavily loaded and runs hot, so that drive energy is lost. Furthermore, the service life of the brake is severely limited.

German Published, Non-Prosecuted Application DE-OS 35 21 152 discloses a method of the generic type described above and an associated apparatus for avoiding ribbon windings. In that method and apparatus, the circumferential speed of the drive drum is varied continuously, and at the same time the cheese or a rotating element connected thereto is braked with variable braking force, in such a way that the circumferential speed of the cheese remains constant within tolerance limits. The average circumferential speed of the drive drum is greater than the average circumferential speed of the cheese.

It is accordingly an object of the invention to provide a method and apparatus for avoiding ribbon windings when winding a cross-wound bobbin, which overcome the hereinaforementioned disadvantages of the heretofore-known methods and devices of this general type and which attain highly effective ribbon breaking with as little effort and expense as possible.

With the foregoing and other objects in view there is provided, in accordance with the invention, a method for avoiding ribbon windings when winding a cross-wound bobbin or cheese being driven by a drive drum having reversing thread grooves for yarn guidance and a drive mechanism having a course of motion, which comprises continuously varying the circumferential speed of the drive drum; accelerating and decelerating the cheese exclusively with the drive drum; accelerating and braking the drive drum with the drive mechanism of the drive drum in accordance with a predeterminable periodic function, especially a sine function; and rotating the cheese with a course of motion following the course of motion of the drive drum in a permanently phase-displaced manner.

Synchronous phases between the cheese and the drive drum are avoided through the use of the invention. During one period of the periodic function, after which the drive drum is accelerated and slowed down, the courses of the circumferential speed of the cheese and the drive drum intersect at only two points. Since there is only momentary synchronous operation at these intersections, it can be assumed that the circumferential speeds of the cheese and drive drum are continuously different from one another. This substantially increases the effect of ribbon breaking.

The invention deviates from the former practice of not allowing the circumferential speed of the drive drum to drop below that of the cheese. This makes it possible to attain more pronounced ribbon breaking even at small slippage variables. The invention makes it possible to dispense with expensive brakes for braking the cheese on the creel.

In accordance with another mode of the invention, there is provided a method which comprises driving the drive drum and the cheese with average circumferential speeds being kept substantially the same.

In accordance with a further mode of the invention, there is provided a method which comprises continuously measuring the bobbin diameter of the cheese, and varying at least one of the frequency and/or the amplitude of the periodic function of the variation in circumferential speed of the drive drum without exceeding a predeterminable value of the phase displacement.

In accordance with an added mode of the invention, there is provided a method which comprises ascertaining the diameter of the cheese varying during the production of the cheese from the ratio between the average angular speeds of the cheese and drive drum at any given time.

In accordance with an additional mode of the invention, there is provided a method which comprises increasing at least one of the amplitude and/or the frequency of the periodic function of the variation in circumferential speed of the drive drum in known primary ribbon zone critical regions in which ribbon windings occur.

With the objects of the invention in view there is also provided an apparatus for avoiding ribbon windings when winding a cross-wound bobbin or cheese, comprising a drive drum for driving the cheese having reversing thread grooves for yarn guidance, and a drive mechanism having means for accelerating and braking the drive drum and means for continuously varying the circumferential speed of the drive drum.

In accordance with another feature of the invention, the drive mechanism includes an electric motor controllable in four-quadrant operation.

In accordance with a further feature of the invention, there is provided an intermediate circuit into which brake energy arising in a braking phase is fed. The ribbon breaking according to the invention does not require a considerable consumption of energy due to the use of an intermediate circuit into which the braking energy that arises in the braking phase can be fed back.

In accordance with an added feature of the invention, the electric motor is operated with multi-phase alternating current and has a characteristic slip curve suitable for arising acceleration moments. The energy consumption can be reduced even further if such an electric motor is used.

In accordance with an additional feature of the invention, there is provided a variable speed gear disposed between the electric motor and the drive drum.

In accordance with yet another feature of the invention, there are provided measured value pickups for detecting the instantaneous angular speed of the drive drum and the cheese, a computer or microprocessor for ascertaining the diameter of the cheese from the ratio of average values of the angular speeds, an operative connection between the computer and the measured value pickups, and a command connection between the computer and the drive mechanism having means for controlling at least one of the amplitude and the frequency of the drive mechanism as a function of the ascertained diameter.

In accordance with yet a further feature of the invention, there is provided a creel, a measured value pickup disposed on the creel for detecting the angular position of the creel proportional to the bobbin diameter, and a command connection between the measured value pickup and the drive mechanism for controlling at least one of the amplitude and the frequency of the periodic function of the variation in circumferential speed of the drive drum.

In accordance with yet an added feature of the invention, the computer includes means for controlling the drive mechanism through the command connection for increasing at least one of the amplitude and/or the frequency of the periodic function of the variation in circumferential speed of the drive drum at times, upon reaching primary ribbon zones recognized from the ascertained diameter of the cheese.

In accordance with a concomitant feature of the invention, there is provided a hysteresis clutch disposed between the electric motor and the drive drum for controlling the amplitude of the periodic function of the variation in circumferential speed of the drive drum.

It is possible, within specified tolerance limits, to keep the phase displacement by which the cheese follows the course of motion of the drive drum virtually constant over the entire bobbin travel, by varying the frequency and/or amplitude of the periodic functions of the variation of the circumferential speed of the drive drum as a function of the diameter of the cheese.

Other features which are considered as characteristic for the invention are set forth in the appended claims.

Although the invention is illustrated and described herein as embodied in a method and apparatus for avoiding ribbon windings when winding a cross-wound bobbin, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a simplified fragmentary, diagrammatic, frontelevational view of a winding station, with a variable speed gear disposed between a motor and a drive drum;

FIG. 2 is a variation of the apparatus of FIG. 1, in which the electric motor is preceded by an inverted rectifier;

FIG. 3 is a graph of the periodic course of the circumferential speeds of the drive drum and cheese;

Figure 4:
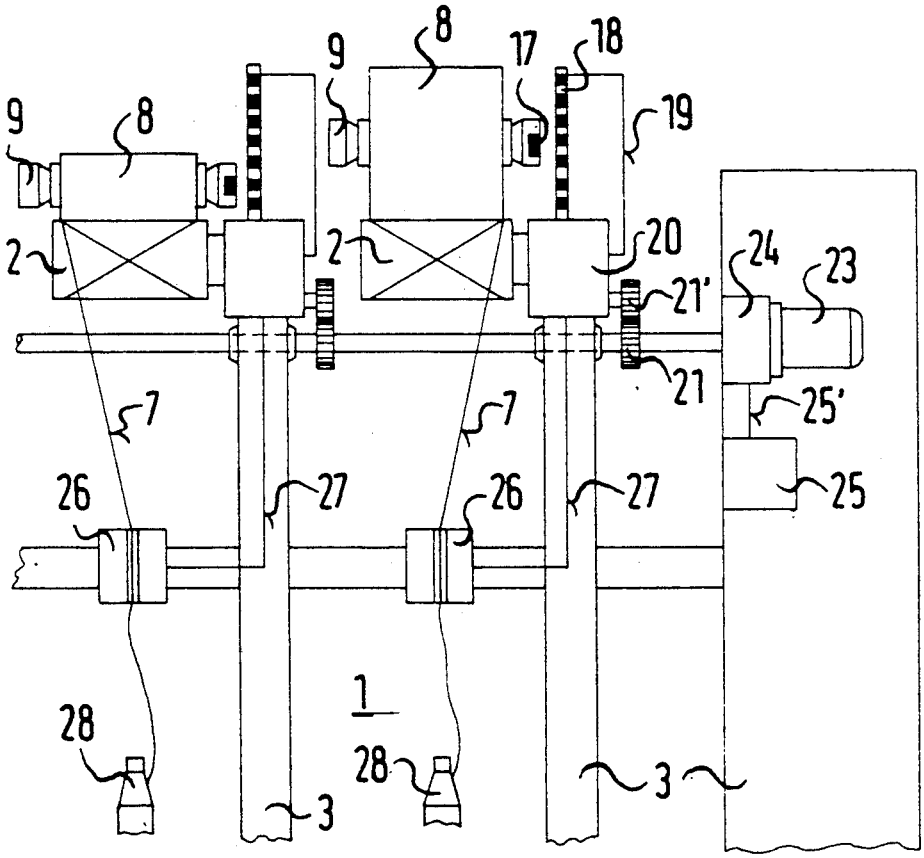
FIG. 4 is a fragmentary view of a portion of a winding machine with a central drive mechanism.

Referring to the figures of the drawing as a whole, there is seen a winding station 1, at which a cross-wound bobbin or cheese 8, supported in a bobbin holder 9, is frictionally driven by a drive drum 2. In this process a yarn or thread 7 drawn from a cop 28 (shown in FIGS. 4, 5 and 6) is wound onto the cheese 8. The yarn 7 is laid parallel to the axis of the cheese 8 by means of a reversing thread groove 2'' formed in the drive drum 2.

The drive drum 2 has a drum shaft 2' which is supported in machine frame 3. The drive of the drum shaft 2' is effected through the pulleys 4 and 4' and a V-belt 4''.

According to a first embodiment of the invention shown in FIG. 1, a variable speed gear 5 is disposed between an electric motor 6 and the pulley 4'. The variable speed gear 5 is controlled by a computer 14 through a control line 15.

A periodic basic function, for example a sine wave function, is fed into the computer 14. During the winding process, the computer receives further information from measured value pickups 10 and 12, which are respectively disposed on the bobbin holder 9 and the drum shaft 2' and connected to the computer through lines 11 and 13. The measured values pickups 10 and 12 are in the form of pulse transducers that respond to the rotational angle, as an example. The computer 14 ascertains the diameter of the cheese 8 at any given time, from a comparison of the average values of the angular speeds of the cheese 8 and drive drum 2. This diameter value correlates with the inertia of the cheese. Either the amplitude or frequency, or both, of the basic function fed in to the computer are accordingly lowered as a function of the diameter value. In this way, the phase displacement between the periodic function of the circumferential speeds of the cheese 8 and drive drum 2 is kept approximately constant during the entire bobbin travel.

A yarn monitor 26 disposed along the path of the yarn 7 is also connected to the computer 14, through a line 27. If the yarn monitor 26 indicates the absence of the yarn 7, or in other words a yarn break, then the computer 14 interrupts the connection between the electric motor 6 and the pulley 4' through the control line 15 and the variable speed gear 5.

According to another embodiment of the invention shown in FIG. 2, an electric motor 6' is connected directly to the pulley 4'. This electric motor 6', which is controllable in four-quadrant operation, is controlled by an inverted rectifier 16. This inverted rectifier 16 receives its control commands through a control line 15' from the computer 14. The generation of the control signals in the computer 14 is effected analogously to the first embodiment. The braking energy liberated in the braking-down phase is recycled through a non-illustrated intermediate circuit. In this way, the additionally required energy for varying the motor speed can be reduced markedly.

The electric motor 6' operated with multi-phase alternating current has a characteristic slip curve that is suitable for the acceleration moments that occur. This provision also leads to an effective use of energy.

The use of the invention is not restricted to driving the winding stations individually. FIG. 4 shows an embodiment in which drive drums 2 of the winding machine are driven through a common drive shaft 22 by an electric motor 23. In this embodiment of the invention, a variable speed gear 24 which is incorporated between the electric motor 23 and the drive shaft 22 transmits the motor rpm to the drive shaft 22 in such a way that the rpm of the shaft fluctuates in accordance with the predetermined basic function. The variable speed gear 24 is controlled by a control unit 25 through a control line 25'.

The rotation of the drive shaft 22 is transmitted to control units 20 through drive wheels 21 and 21'.

In this embodiment of the invention, the instantaneous diameter of the cheese 8 is ascertained by a measured value pickup that is in the form of a light source 17 secured to the bobbin holder 9, and a photoelectric cell array 18 disposed parallel to the path pursued by the light source 17 during the bobbin travel.

At a given time, the photoelectric cells of the photoelectric cell array 18 located opposite the light source 17 emit a signal, corresponding to the diameter of the cheese 8, to the control unit 20 through a line 19. A hysteresis clutch may, for instance, be disposed in this control unit 20. The rpm fluctuations that have been introduced by the drive shaft 22 are transmitted by this clutch to variably pronounced extents as a function of the applied voltage. Thus as the diameter of the cheese 8 increases, the amplitude of the transmitted periodic function of the rpm variation or circumferential speed variation of the drive drum 2 decreases. Furthermore, similarly to the embodiments described above, in the event of yarn breakage that is detected by the yarn monitor 26, a non-illustrated clutch inside the control unit 20 is actuated through the line 27.

Figure 5:
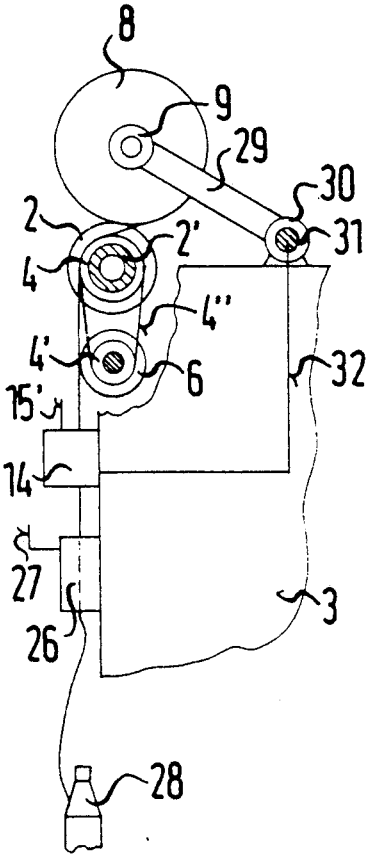
FIG. 5 is a fragmentary and partly broken-away sideelevational view of a winding station with a separate drive mechanism for the drive drum and a measured value pickup for the angular position of the creel.
Figure 6:
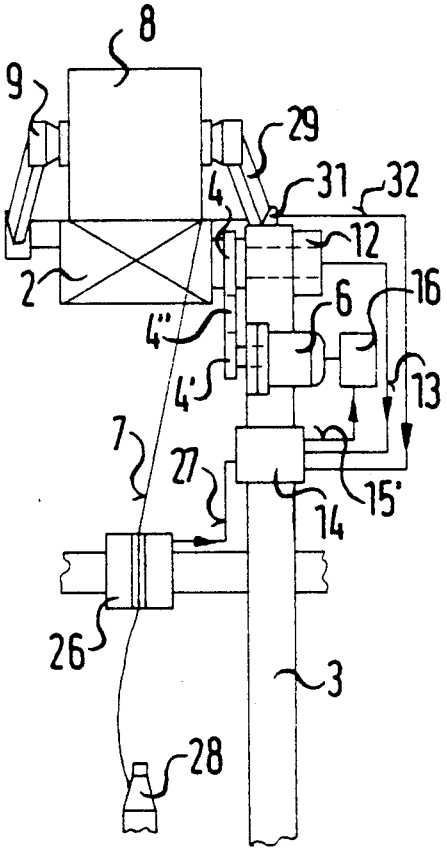
FIG. 6 is a front-elevational view of the winding station of FIG. 5.

A further embodiment for detecting the instantaneous diameter of the cheeses 8 at any given time is shown in FIGS. 5 and 6. In this case the angular position of a creel 29, which is supported in a creel shaft 30, is detected by a measured value pickup 31 which may, for instance, be in the form of a variable resistor The voltage values corresponding to the angular position of the creel 29 are transmitted to the computer 14 through a line 32. Direct transmission to the control unit 20 for actuating the hysteresis clutch is also possible.

If the control is performed by the computer 14, then upon reaching primary ribbon zones for which the various diameter values are fed in, it can increase the amplitude and/or frequency of the periodic function of the circumferential speed variation of the drive drum 2, until leaving these primary ribbon zones.

The diagram shown in FIG. 3 illustrates the sinusoidal course of the circumferential speeds of the drive drum 2 (Va) and the cheese 8 (Vsp) as a function of time (t). This graph also shows that the cheese 8 permanently follows the course of motion of the drive drum 2 in a phase-displaced manner. It can additionally be seen that within one period, only two intersections of the circumferential speeds occur. Accordingly, the synchronous operation between the drive drum 2 and the cheese 8 is limited to these intersections. The result is that extremely effective ribbon disentangling or dissolution is attained. The average circumferential speeds of the drive drum 2 and cheese 8 are the same (Va, sp).

Since relatively high-efficiency ribbon disentanglement or dissolution is attained when the invention is used, it is possible to work at relatively low acceleration values. If the frequency of the periodic function of the course of motion of the drive drum 2 is in the range of 1 Hz, it is not only possible to attain effective ribbon breaking, but excessive strain on the yarn in the upper layers of yarn on the cheese 8 can also be avoided as well. The phase displacement depends not only on the parameters of the periodic function of the circumferential speed variation of the drive roller and on the diameter of the cheese 8 but also on the yarn wound onto the bobbin, and in particular its roughness With relatively smooth yarns, the same phase displacement is therefore attained even at a low amplitude of the aforementioned periodic function In the normal situation, this amplitude should not exceed 12% of the average circumferential speed, because otherwise in the braking phase the yarn could fall off the ends of the cheeses 8. If the aforementioned values are adhered to, the ribbon breaking according to the invention does not cause such yarn fall-off.

I claim:

1. Method for avoiding ribbon windings when winding a cross-wound bobbin or cheese being driven by a drive drum having reversing thread grooves for yarn guidance and a drive mechanism having a course of motion, which comprises continuously varying the circumferential speed of the drive drum; accelerating and decelerating the cheese exclusively with the drive drum; accelerating and braking the drive drum with the drive mechanism of the drive drum in accordance with a predeterminable periodic function; and rotating the cheese with a course of motion following the course of motion of the drive drum in a permanently phase-displaced manner.

2. Method according to claim 1, which comprises setting the predeterminable periodic function as a sine function.

3. Method according to claim 1, which comprises driving the drive drum and the cheese with substantially the same average circumferential speeds.

4. Method according to claim 1, which comprises continuously measuring the bobbin diameter of the cheese, and varying at least one of the frequency and the amplitude of the periodic function of the variation in circumferential speed of the drive drum without exceeding a predeterminable value of the phase displacement.

5. Method according to claim 1, which comprises ascertaining the diameter of the cheese varying during the production of the cheese from the ratio between the average angular speeds of the cheese and drive drum at any given time.

6. Method according to claim 1, which comprises increasing at least one of the amplitude and the frequency of the periodic function of the variation in circumferential speed of the drive drum in known primary ribbon zone critical regions in which ribbon windings occur.

7. Apparatus for avoiding ribbon windings when winding a cross-wound bobbin or cheese, comprising a drive drum for driving the cheese having reversing thread grooves for yarn guidance, and a drive mechanism having means for accelerating and braking said drive drum and means for continuously varying the circumferential speed of said drive drum.

8. Apparatus according to claim 7, wherein said drive mechanism includes an electric motor controllable in fourquadrant operation.

9. Apparatus according to claim 7, including an intermediate circuit into which brake energy arising in a braking phase is fed.

10. Apparatus according to claim 7, wherein said drive mechanism includes an electric motor being operated with multi-phase alternating current and having a characteristic slip curve suitable for arising acceleration moments

11. Apparatus according to claim 7, wherein said drive mechanism includes an electric motor, and a variable speed gear disposed between said electric motor and said drive drum.

12. Apparatus according to claim 7, including measured value pickups for detecting the instantaneous angular speed of said drive drum and the cheese, a computer for ascertaining the diameter of the cheese from the ratio of average values of the angular speeds, an operative connection between said computer and said measured value pickups, and a command connection between said computer and said drive mechanism having means for controlling at least one of the amplitude and the frequency of said drive mechanism as a function of the ascertained diameter.

13. Apparatus according to claim 7, including a creel, a measured value pickup disposed on said creel for detecting the angular position of said creel proportional to the bobbin diameter, and a command connection between said measured value pickup and said drive mechanism for controlling at least one of the amplitude and the frequency of the periodic function of the variation in circumferential speed of said drive drum.

14. Apparatus according to claim 12, wherein said computer includes means for controlling said drive mechanism through said command connection for increasing at least one of the amplitude and the frequency of the periodic function of the variation in circumferential speed of the drive drum at times, upon reaching primary ribbon zones recognized from the ascertained diameter of the cheese.

15. Apparatus according to claim 13, wherein said computer includes means for controlling said drive mechanism through said command connection for increasing at least one of the amplitude and the frequency of the periodic function of the variation in circumferential speed of the drive drum at times, upon reaching primary ribbon zones recognized from the ascertained diameter of the cheese.

16. Apparatus according to claim 13, wherein said drive mechanism includes an electric motor, and a hysteresis clutch disposed between said electric motor and said drive drum for controlling the amplitude of the periodic function of the variation in circumferential speed of said drive drum.

17. Apparatus according to claim 14, wherein said drive mechanism includes an electric motor, and a hysteresis clutch disposed between said electric motor and said drive drum for controlling the amplitude of the periodic function of the variation in circumferential speed of said drive drum.

18. Apparatus according to claim 15 wherein said drive mechanism includes an electric motor, and a hysteresis clutch disposed between said electric motor and said drive drum for controlling the amplitude of the periodic function of the variation in circumferential speed of said drive drum.

19. Apparatus for avoiding ribbon windings when winding a cross-wound bobbin or cheese, comprising a drive drum for exclusively accelerating and decelerating the cheese, said drive drum having reversing thread grooves for yarn guidance, and a drive mechanism having means for continuously varying the circumferential speed of the drive drum, means for accelerating and braking the drive drum according to a course of motion having a predeterminable periodic function, and means for rotating the cheese with a course of motion following the course of motion of the drive drum in a permanently phase-displaced manner.

* * * * *